US005337690A

United States Patent [19]

Moisdon

[11] Patent Number: 5,337,690

[45] Date of Patent: Aug. 16, 1994

[54] VERTICAL SAIL BOAT

[76] Inventor: Roger G. F. Moisdon, 4875 SW. 28th Ave., Fort Lauderdale, Fla. 33312

[21] Appl. No.: 93,050

[22] Filed: Jul. 16, 1993

[51] Int. Cl.[5] ..... B63B 1/12

[52] U.S. Cl. ..... 114/39.1; 114/56; 114/59

[58] Field of Search ..... 114/39.1, 56, 59, 264

[56] References Cited

U.S. PATENT DOCUMENTS 4,054,104 10/1977 Haselton ..... 114/264
4,656,959 4/1987 Moisdon ..... 114/59
4,843,987 7/1989 Samuels ..... 114/39.1

*Primary Examiner*—Jesus D. Sotelo
*Attorney, Agent, or Firm*—Herbert L. Lerner; Laurence A. Greenberg

[57] ABSTRACT

One embodiment of a vertical watercraft for stable transport in rough seas includes a normally above-waves sail, a normally vertically-disposed elongate hull being normally substantially submarine in operation, and an adjustable ballast device. The ballast device is disposed within the hull for maintaining the sail above water and for regulating trim, attitude and bottom clearance of the hull under different loads and operating conditions. In another embodiment, the vertical watercraft includes a normally above-waves inflatable sail, a mast connected to the sail, a folding raft connected to the mast, and a normally vertically-disposed, elongate, folding hull being connected to the raft and normally substantially submarine in operation. A differential air pressure may be applied through apertures in the sail for curving the sail, and a differential air pressure may be applied through apertures in the hull for curving the hull.

13 Claims, 2 Drawing Sheets

FIG.3
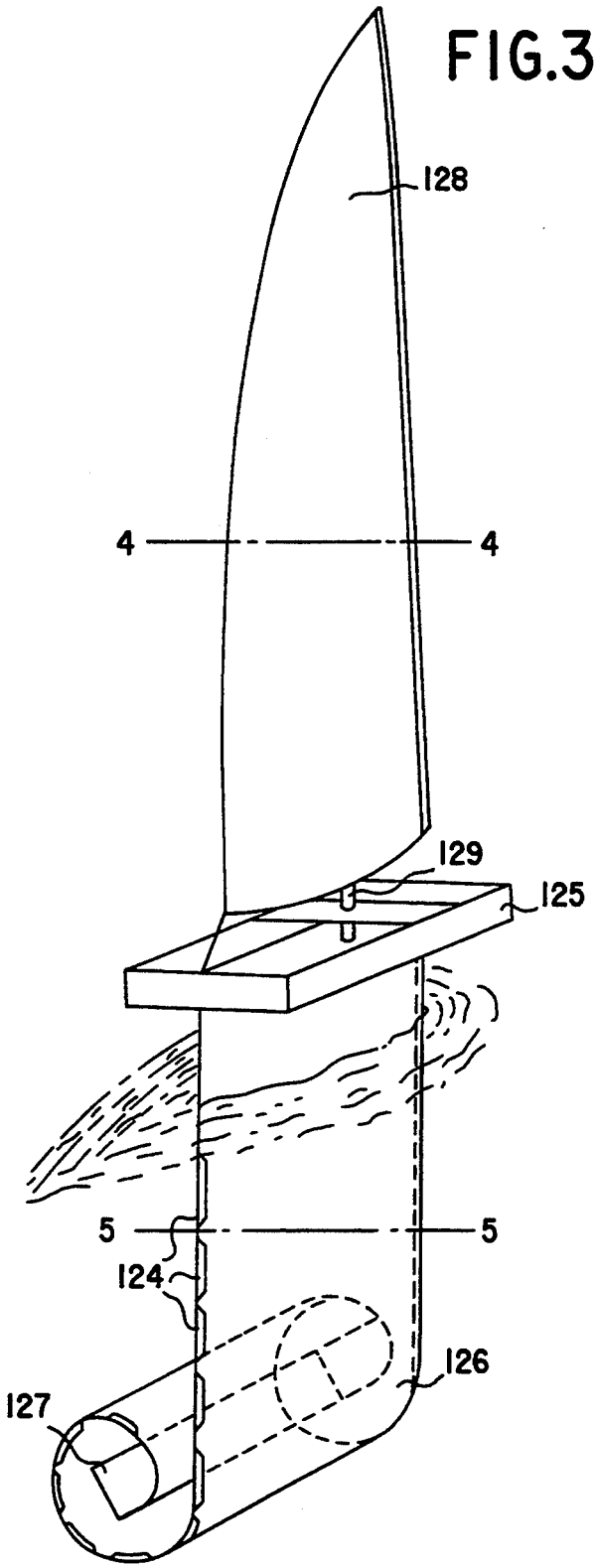
FIG.4
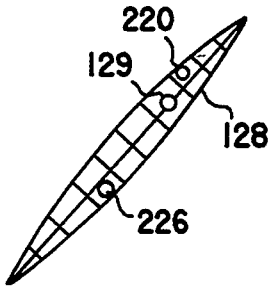
FIG.5a
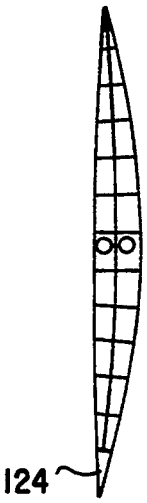
FIG.5c
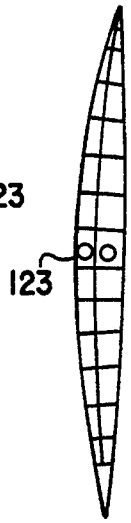
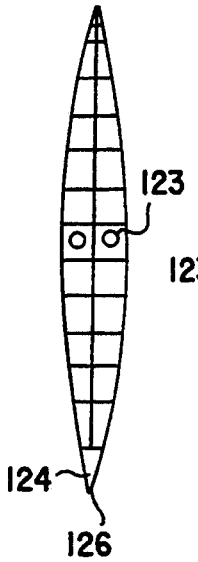
FIG.5b

VERTICAL SAIL BOAT

BACKGROUND OF THE INVENTION

1. Field of the Invention

The present invention relates generally to watercraft and, more particularly, to a novel watercraft termed herein a "vertical sail boat".

2. Description of the Related Art

The present state-of-the-art in vertical boat and ship technology discloses only the use of mechanical propulsion, which has some deficiencies, such as: noise, vibrations, odors and worst of all, fossil fuel consumption. For example, U.S. Pat. No. 4,656,959, having the same inventor as this invention, discloses a vertical ship using a mechanical propulsion mechanism. State-of-the-art sail boats are unstable, slow and dangerously difficult to handle.

SUMMARY OF THE INVENTION

The present inventive vertical ship involves the usage of sails and more particularly the use of mechanical sails, which are housed inside the vertical hull or affixed outside the hull, for example, one at each corner of a paralleled deck, providing easy trim control of large sail surfaces, and secure, easy ship handling.

It is thus an object of the present invention to provide a vertical sail boat or ship which can sail the oceans and seas in comfort and security using wind energy as propulsion means, in a vertical hull which provides total stability, which are qualities that are lacking in most sailing ships.

It is a further object to provide a vertical sail boat capable of reacting swiftly to correct changes of attitude due to changes of wind directions and velocity by the use of special water-ballast tanks. It is yet a further object to provide a vertical sail boat equipped with means facilitating the controls and trims of the sails. It is still a further object to provide a foldable sport version of a vertical sail boat.

The above and yet further objects and advantages of the present invention will become apparent in the hereinafter set forth detailed description of the invention, the drawings and claims appended herewith.

With the foregoing and other objects in view there is provided, in accordance with the invention, a ALL OF THE CLAIMS WILL BE REPEATED HERE.

BRIEF DESCRIPTION OF THE DRAWINGS

FIG. 3 is a perspective view of a sport version of a vertical sail boat of the invention;

FIG. 4 is a cross-sectional view of an inflatable sail, taken along a line 4—4 in FIG. 3; and FIG. 5A, 5B, and 5C is a group of three cross-sectional views of different inflation curvatures of an inflatable hull, taken along a line 5—5 in FIG. 3.

DESCRIPTION OF THE PREFERRED EMBODIMENTS

Figure 1:
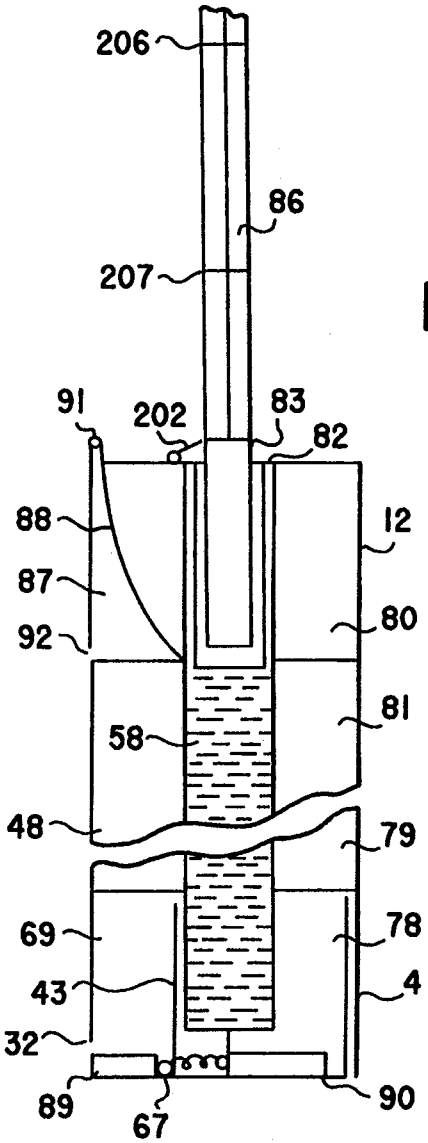
FIG. 1 is a fragmentary, diagrammatic, cross-sectional front elevation view of a vertical sail boat of the invention, taken along a line 10—10 of FIG. 2.

Referring now to the figures of the drawing in detail and first, particularly, to FIG. 1 thereof, it is seen that reference numeral 12 designates a vertical sail boat or sail-type vertical watercraft according to the invention, which is illustrated by way of example in the form of one type of vertical sail boat for high seas sailing. It is to be understood, however, that the principles of the invention can be applied as well to other types of vertical watercrafts, and of course the same applies for each of the other embodiments described herein.

Figure 2:
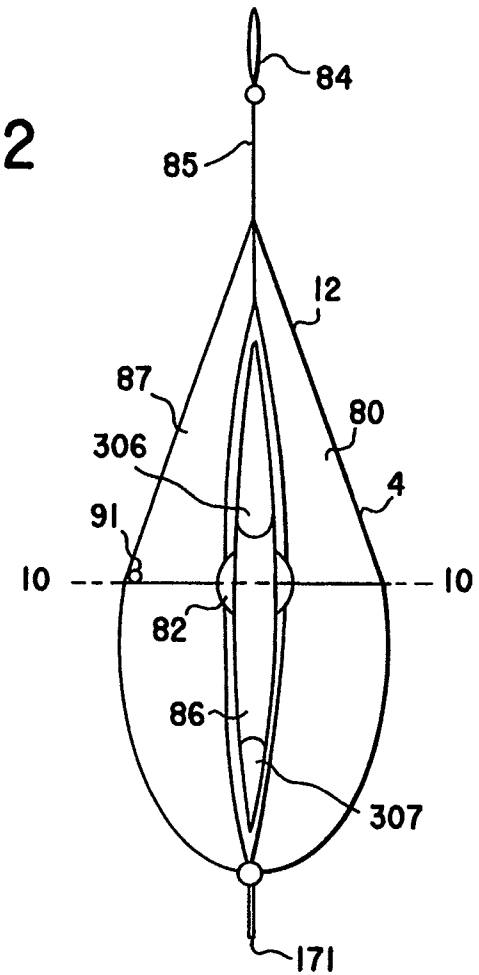
FIG. 2 is a plan view of the vertical sail boat.

As is illustrated in FIGS. 1 and 2, the sail-type vertical watercraft 12 includes a mechanical or stiff, hollow sail 86 fitted on a telescoping mast 83 rotating in a bearing 82 which can slide vertically in a sail shaft 58. The sail 86 articulates at joints 206 and 207 which permit each section of the sail between the joints to rotate about a vertical axis relative to the other sections, for the purpose of trimming the sail. In this way, it is possible to have at least one section of the sail remain within the shaft 58 and yet still permit rotation of the section or sections above the shaft. The sail may have flaps 306, 307 formed thereon for trimming the sail. The shaft 58 contains liquid permitting the housing of the mechanical sail 86 to float at a level determined by the amount of liquid. A hull 4 of the vertical sail boat has a modular construction for convenience and economy which is greatly facilitated by the fact that a vertical watercraft hull does not have to withstand the bending effect imposed on ordinary ships and boats by the waves of the sea. For that purpose, ballast tanks such as elements 87, 48, 69 on one side and 80, 81, 78 on the other side of the shaft 58 are affixed one on top of the other and are used for tilt, attitude and buoyancy control due to trim. In water ballast tanks such as the tank 87, at least one wall 88 is specially curved in order to obtain a variable flooding rate, permitting more flexibility of control. For fast ballasting response in tilt, attitude and buoyancy controls, tanks such as the tanks 87 through 69 are of the "open to the sea" type due to a long, rectangular, horizontal slot 32, 92 which is cut into the bottom part of the outside wall that is in contact with the sea, permitting very fast hallasting operations through the use of compressed air admitted on top of the water through pipes such as a pipe 91. An alternative hallasting system may be provided by elements 89, 67 and 90 that operate in manner to be described below. These elements are heavy for producing a hallasting effect at the bottom of the hull 4 which is totally independent of outside fluid filling. A rudder 171 is provided for the correction of tilt while under sail. A boom 85 is attached to the hull 4 and a rudder 84 is attached to the boom.

The ballasting system 89, 67 and 90 functions as follows:

Gas which is contained in the ballast tank 69 passes through a pipe 43 and a valve 67 into a cylinder 90 where it is compressed until it reaches the liquid state. The ballast tank 69 is consequently filled with water since it is open to the sea through the slot 32. When the valve 67 is open, the gas contained in the cylinder 90 flows out through the pipe 43 and pushes out the water contained in the tank 69 until a non-illustrated floating limiter closes the valve 67 which concludes the ballasting-out operation. When flooding of the ballast tank 69 is needed, a gas compressor 89 refills the cylinder 90 through the pipe 43 allowing water in again until the tank 69 is filled up again. The gas compressor 89 is switched off by a non-illustrated float switch which concludes the ballasting-in operation. The "tear-drop" shape of the hull 4 represented in FIG. 2 is preferably used in order to benefit from a lower water resistance due to a reduction of eddy currents on the stern or aft part of the hull 4.

As is illustrated in FIGS. 3, 4 and 5A, 5B, 5C, a recreational version of the vertical watercraft includes a foldable raft 125 that is water-tightly fitted to an inflatable hull 126 in the bottom of which an air compressor 127 is installed. Air-pressurized propulsive slots such as slots 124 are formed in a trailing edge of the inflatable hull 126. Mounted on the floor of the inflatable raft 125 is a mast 129 on which an inflatable sail 128 is rigged. The hull 126 can be curved on one side or the other, by virtue of an air differential pressure applied through apertures 123 shown in FIGS. 5A, 5B, 5C. The same air differential pressure applied through apertures 220, 226 allows a change in the curvature of the sail 128.

The device functions as follows:

The foldable raft 125 is either assembled or inflated according to the type chosen. The inflatable hull 126 is rolled and attached to the bottom of the raft 125. The raft and hull assembly is launched and then the hull 126 is allowed to unroll and extend downwardly. The hull 126 is then filled with water to the required level, then air pressure is added on top of the water in order to adjust the required pressure that is capable of keeping the hull 126 in the desired shape and of adjusting the floatation level of the vertical watercraft to the desired level. The mast 129 and the sail 128 are applied to the raft 125 and the inflated sail 128 is rigged to the stern of the raft 125. The steering is accomplished through pressure variations between port and starboard sides of the inflated hull 126, which is pressure-adjusted either by a hand air pump or by the air compressor 127 which, being located at the bottom of the hull 126, adds a hallasting weight to the hull 126 and provides an auxiliary propulsion system through the airjet slots 124. The air compressor 127 can be replaced by a high-pressure water pump providing a similar type of auxiliary propulsion, or by a gas-compressed cylinder.

I claim:

1. A vertical watercraft for stable transport in rough seas, comprising:

a. a normally above-waves sail;

b. a normally vertically-disposed, elongate hull, normally substantially submarine in operation; and c. adjustable ballast means disposed within said hull to maintain said sail above water and to regulate trim, attitude and bottom clearance of said hull under different loads and operating conditions.

2. The vertical watercraft according to claim 1, wherein said sail is rigid and has a telescoping mast.

3. The vertical watercraft according to claim 1, including a mast attached to said sail, a bearing rotatably supporting said mast, and a hollow shaft in said hull being filled with liquid on which said bearing is supported.

4. The vertical watercraft according to claim 1, including a boom attached to said hull, and a rudder attached to said boom.

5. The vertical watercraft according to claim 1, wherein said ballast means include a ballast tank having an opening formed therein for the passage of sea water, a cylinder connected to said ballast tank, means for emptying gas from said ballast tank into said cylinder permitting sea water to fill said empty ballast tank through said opening, and means for compressing gas in said cylinder into a liquid state.

6. The vertical watercraft according to claim 1, wherein said ballast means include a plurality of ballast tanks being disposed one on top of the other, at least one of said tanks having at least one wall being curved for additional ballast control.

7. The vertical watercraft according to claim 1, wherein said sail is stiff and hollow.

8. The vertical watercraft according to claim 1, including a rudder attached to said hull for correction of tilt while under sail.

9. The vertical watercraft according to claim 1, wherein said sail has at least one articulation location for rotating said sail in sections.

10. The vertical watercraft according to claim 1, wherein said hull has a tear drop shape, as seen in cross section, for lowering water resistance.

11. A vertical watercraft for stable transport in rough seas, comprising:

a. a normally above-waves inflatable sail;

b. a mast connected to said sail;

c. a folding raft connected to said mast;

d. a normally vertically-disposed, elongate, folding hull connected to said raft and normally substantially submarine in operation;

e. means for applying a differential air pressure through apertures formed in said sail for curving said sail; and f. means for applying a differential air pressure through apertures formed in said hull for curving said hull.

12. The vertical watercraft according to claim 11, wherein said hull has propulsive slots formed therein, and said hull has an air compressor communicating with said slots for forcing air through said slots and propelling the watercraft.

13. The vertical watercraft according to claim 11, wherein said hull has a trailing edge in which said propulsive slots are formed.

* * * * *